US012631031B2

(12) United States Patent
Ouyang et al.

(10) Patent No.: US 12,631,031 B2
(45) Date of Patent: May 19, 2026

(54) PERIODIC AND NONPERIODIC TILING SYSTEM BASED ON REGULAR HEXAGONS

(71) Applicant: Chunli Du, Ganzhou (CN)

(72) Inventors: Peichang Ouyang, Liuzhou (CN); Alain Luc Gilles Nicolas, Liuzhou (CN)

(73) Assignee: Chunli Du, Ganzhou (CN)

( * ) Notice: Subject to any disclaimer, the term of this patent is extended or adjusted under 35 U.S.C. 154(b) by 336 days.

(21) Appl. No.: 18/447,313

(22) Filed: Aug. 10, 2023

(65) Prior Publication Data

US 2023/0383544 A1 Nov. 30, 2023

(30) Foreign Application Priority Data

Jul. 6, 2023 (CN) ..... 202310821891.6

(51) Int. Cl.
*E04F 15/02* (2006.01)

(52) U.S. Cl.
CPC ..... *E04F 15/02* (2013.01)

(58) Field of Classification Search
CPC ..... E04F 15/02; E04F 13/0871; E04F 13/08; E04F 2203/02; B44C 3/123
See application file for complete search history.

(56) References Cited

U.S. PATENT DOCUMENTS 1,474,779 A * 11/1923 Zur Kammer ..... B44C 3/123 52/311.2
4,133,152 A * 1/1979 Penrose ..... B44F 5/00 D25/138
5,211,692 A * 5/1993 Lalvani ..... B44C 3/123 52/311.2
5,267,810 A * 12/1993 Johnson ..... E01C 5/06 404/41
5,524,396 A * 6/1996 Lalvani ..... E04B 1/19 52/311.2
5,575,125 A * 11/1996 Lalvani ..... A63F 9/0669 52/311.2
5,619,830 A * 4/1997 Osborn ..... A63F 9/0669 D25/138
5,775,040 A * 7/1998 Lalvani ..... A63F 9/10 52/311.2
D431,871 S * 10/2000 Abbrancati ..... D25/113
6,881,463 B2 * 4/2005 Riccobene ..... E04C 1/395 428/44

(Continued)

*Primary Examiner* — Gisele D Ford
(74) *Attorney, Agent, or Firm* — Hemisphere Law, PLLC

(57) ABSTRACT

The present invention discloses a periodic and nonperiodic tiling system based on regular hexagons, comprising seven different types of prototiles. Each type of prototiles are based on a regular hexagon structure, and external contours of each type of prototiles are composed of six boundary contours. In a connected pattern enclosed by the six boundary contours, the areas of parts convex from and concave into a regular hexagon are correspondingly equal. A specific shape of an animal, plant or human figure is enclosed by the six boundary contours, and a plurality of specific shapes enclosed by the six boundary contours are engaged with each other to form a tiling surface. The prototiles are provided with a corresponding pattern according to the boundary contours of the specific shape. The present invention is simple in structure and diversified in tiling effect, and has a wide application prospect.

1 Claim, 22 Drawing Sheets

(56) References Cited

U.S. PATENT DOCUMENTS 7,393,155 B2 * 7/2008 Riccobene ..... E01C 5/00 52/603
7,637,688 B2 * 12/2009 Riccobene ..... E04F 15/02 428/44
7,850,393 B2 * 12/2010 Hamel ..... E01C 5/06 404/34
D664,677 S * 7/2012 Riccobene ..... D25/113
8,226,323 B2 * 7/2012 Bouchard ..... B44C 5/06 404/34
8,668,404 B2 * 3/2014 Bouchard ..... B44C 1/28 404/34
2003/0136069 A1 * 7/2003 Geissler ..... B44F 3/00 52/311.2
2004/0191461 A1 * 9/2004 Riccobene ..... E04F 15/02 428/44
2006/0182923 A1 * 8/2006 Riccobene ..... E04C 1/395 428/44
2007/0077387 A1 * 4/2007 Riccobene ..... B44F 3/00 428/44
2008/0095577 A1 * 4/2008 Brun ..... E01C 5/00 404/42
2008/0240857 A1 * 10/2008 Ciccarello ..... E01C 5/06 404/41
2011/0000149 A1 1/2011 Beyder et al.
2011/0067333 A1 * 3/2011 Lacas ..... E04F 13/141 52/311.1
2011/0094177 A1 4/2011 Licciardi
2011/0293873 A1 * 12/2011 Riccobene ..... E04B 2/12 428/44
2014/0124472 A1 * 5/2014 Radvanyi ..... A63F 9/10 428/66.7
2014/0205807 A1 * 7/2014 Lacas ..... E04F 15/02161 428/157
2017/0034940 A1 * 2/2017 Frattalone ..... E04F 13/30
2023/0194993 A1 6/2023 Pacione
2023/0287689 A1 * 9/2023 Birzhev Rudatskiy ..... E04F 13/0889

* cited by examiner

PERIODIC AND NONPERIODIC TILING SYSTEM BASED ON REGULAR HEXAGONS

TECHNICAL FIELD

The present invention belongs to the technical field of tiling structures, and particularly relates to a periodic and nonperiodic tiling system based on regular hexagons.

BACKGROUND

Tiling refers to using several patterns to pave an entire surface without any overlapping or gap. In addition to being widely used in ceramic tiles, the tiling of a planar pattern is also used in mathematics teaching. For example, by exploring the process of polygon tiling conditions, the reasoning ability and aesthetic ability of a student can be further developed, the application of the planar pattern in real life, for example the application in a puzzle splicing board, can be experienced, and the thinking of a child can be better inspired.

Tiling is divided into periodic tiling, nonperiodic tiling and aperiodic tiling. If a prototile can be used to construct a basic pattern first, and then the basic pattern can be translated in two different directions to cover the entire surface without any gap or overlapping, then the prototile is called a periodic prototile, and the corresponding tiling is called periodic tiling. An aperiodic prototile refers to a prototile which cannot be used to construct periodic tiling. A nonperiodic prototile refers to a prototile which can be used to construct both periodic tiling and nonperiodic tiling.

People have deeply studied the intelligence inspiring and decorative functions of tiling. For example, Roger Penrose, a Nobel laureate, has invented the influential Penrose tiling (U.S. Pat. No. 4,133,152), and John A. L. Osborn has invented the Escher style of art tiling (U.S. Pat. Nos. 5,481,841, 5,520,388 and 5,619,830). However, the tiling found at present has the following defects. First, most of the periodic, nonperiodic or aperiodic tiling puzzles have more than one type of pieces. Too many types of pieces make the puzzles lack of unified and harmonious artistic beauty, and the manufacturing cost is high. Second, the geometric structure of periodic tiling is too simple, lacks challenge, and is not attractive. Third, compared with periodic tiling, the structure of nonperiodic or aperiodic tiling is more difficult, however, such tiling usually has a small number of solutions and lacks variation, so a player will soon lose interest after understanding the law of tiling.

Therefore, the problem to be urgently solved by those skilled in the art is how to provide a nonperiodic tiling system which has a simple structure and a low manufacturing cost, and can realize a variety of tiling effects by the combination of the same type of prototiles.

SUMMARY

In view of this, the present invention discloses a periodic and nonperiodic tiling system based on regular hexagons, which can provide tiling with different contours and beautiful and rich styles, and has broad research and development potentials; prototiles provided by the present invention is suitable for Escher style of art and has a good affinity and an intelligence inspiring function for children; the prototiles not only allow periodic and nonperiodic tiling, but also provide tiling with a variety of construction modes, which can be widely used in the fields of educational toys, developmental games and artistic decoration, and have good aesthetic and economic application potentials.

To achieve the above purpose, the present invention adopts the following technical solution: a periodic and nonperiodic tiling system based on regular hexagons, comprising a plurality of prototiles, the prototiles are based on a regular hexagon structure, each prototile has a first corner point, a second corner point, a third corner point, a fourth corner point, a fifth corner point and a sixth corner point corresponding to the regular hexagon structure, and a boundary contour is arranged between any two adjacent corner points; in the boundary contours corresponding to the prototile, the areas of parts convex from and concave into each regular hexagon are equal, contour edges with a specific shape are formed by a plurality of boundary contours on the prototile, and the contour edges with the specific shape of the plurality of prototiles are engaged with each other to form a periodic tiling system or a nonperiodic tiling system; a specific shape of an animal, plant or human figure is jointly formed by the plurality of boundary contours on the prototile, the prototile is provided with a corresponding textured pattern according to the boundary contours of the specific shape, and the present invention comprises seven different types of prototiles.

The present invention has the following beneficial effects: a pattern with a specific shape is formed by transforming from a regular hexagon prototile, boundaries with a specific shape of an animal, plant or human figure is formed by six boundary contours, and the area enclosed by the six boundary contours is the same as that of the original regular hexagon. Compared with the traditional tiling, complex tiling can be realized by a single type of prototiles in the present invention, which greatly simplifies the manufacturing process and reduces the production cost. In combination with the mirroring, translation and rotation transformation of the prototiles, a variety types of tiling can be constructed. In combination with the processing and design by artists, the present invention can provide art patterns with different contours and beautiful and rich styles, has a good affinity and an intelligence inspiring function for children, and has broad research and development potentials; the prototiles not only allow periodic and nonperiodic tiling, but also make up for the major defects of the traditional tiling as the constructed tiling has the characteristics of difficult solving and numerous solutions. The present invention can be widely used in the fields of educational toys, developmental games and artistic design and decoration, and has good aesthetic and economic application potentials.

Preferably, for a first type of prototiles, a first boundary contour is arranged between the first corner point and the second corner point, the first boundary contour is provided with a boundary anchor point, the boundary anchor point is located outside a regular hexagon, the boundary anchor point is located on the perpendicular bisector of the connecting line between the first corner point and the second corner point, the first boundary contour is symmetric about the perpendicular bisector of the connecting line between the first corner point and the second corner point, the first boundary contour is rotated counterclockwise by 120° around the second corner point to form a second boundary contour, a center line is formed by the connecting line between the third corner point and the sixth corner point, the first boundary contour is mirror-symmetric about the center line to form a fourth boundary contour, the fourth boundary contour is rotated clockwise by 120° around the fourth corner point to form a third boundary contour, a sixth boundary contour is arranged between the first corner point and the sixth corner point, and the sixth boundary contour is rotated clockwise by 120° around the sixth corner point to form a fifth boundary contour.

Preferably, for a second type of prototiles, a first boundary contour is arranged between the first corner point and the second corner point, the first boundary contour is provided with a boundary anchor point, the boundary anchor point is located inside a regular hexagon, the first boundary contour is symmetric about the perpendicular bisector of the connecting line between the first corner point and the second corner point, the first boundary contour is rotated counterclockwise by 120° around the second corner point to form a second boundary contour, the first boundary contour is mirrored about the connecting line between the third corner point and the sixth corner point to form a fourth boundary contour, the fourth boundary contour is rotated clockwise by 120° around the fourth corner point to form a third boundary contour, a sixth boundary contour is arranged between the first corner point and the sixth corner point, and the sixth boundary contour is rotated clockwise by 120° around the sixth corner point to form a fifth boundary contour.

Preferably, for a third type of prototiles, a first boundary contour is arranged between the first corner point and the second corner point, the first boundary contour is provided with a boundary anchor point, the boundary anchor point is located inside a regular hexagon, the first boundary contour is symmetric about the perpendicular bisector of the connecting line between the first corner point and the second corner point, the first boundary contour is rotated counterclockwise by 120° around the second corner point to form a second boundary contour, the second boundary contour is rotated counterclockwise by 120° around the third corner point to form a third boundary contour, the third boundary contour is rotated counterclockwise by 120° around the fourth corner point to form a fourth boundary contour, a sixth boundary contour is arranged between the first corner point and the sixth corner point, and the sixth boundary contour is rotated clockwise by 120° around the sixth corner point to form a fifth boundary contour.

Preferably, for a fourth type of prototiles, a first boundary contour is arranged between the first corner point and the second corner point, the first boundary contour is provided with a boundary anchor point, the boundary anchor point is located outside a regular hexagon, the first boundary contour is symmetric about the perpendicular bisector of the connecting line between the first corner point and the second corner point, the first boundary contour is rotated counterclockwise by 120° around the second corner point to form a second boundary contour, the second boundary contour is rotated counterclockwise by 120° around the third corner point to form a third boundary contour, the third boundary contour is rotated counterclockwise by 120° around the fourth corner point to form a fourth boundary contour, a sixth boundary contour is arranged between the first corner point and the sixth corner point, and the sixth boundary contour is rotated clockwise by 120° around the sixth corner point to form a fifth boundary contour.

Preferably, for a fifth type of prototiles, a first boundary contour is arranged between the first corner point and the second corner point, the first boundary contour is provided with a boundary anchor point, the boundary anchor point is located inside a regular hexagon, the first boundary contour is symmetric about the perpendicular bisector of the connecting line between the first corner point and the second corner point, a second boundary contour which is in the same state as the first boundary contour is arranged between the second corner point and the third corner point, and a sixth boundary contour which is in the same state as the first boundary contour is arranged between the first corner point and the sixth corner point; the second boundary contour is rotated counterclockwise by 120° around the third corner point to obtain a third boundary contour, a fourth boundary contour which is in the same state as the third boundary contour is arranged between the fourth corner point and the fifth corner point, and a fifth boundary contour which is in the same state as the fourth boundary contour is arranged between the fifth corner point and the sixth corner point.

Preferably, for a sixth type of prototiles, a first boundary contour is arranged between the first corner point and the second corner point, the first boundary contour is provided with a boundary anchor point, the boundary anchor point is located outside a regular hexagon, the first boundary contour is symmetric about the perpendicular bisector of the connecting line between the first corner point and the second corner point, the first boundary contour is rotated counterclockwise by 120° around the second corner point to form a second boundary contour, the second boundary contour is rotated counterclockwise by 120° around the third corner point to form a third boundary contour, the third boundary contour is rotated counterclockwise by 120° around the fourth corner point to obtain a fourth boundary contour, the third boundary contour is mirrored about the connecting line between the second corner point and the fifth corner point to form a sixth boundary contour, and the sixth boundary contour is rotated clockwise by 120° around the sixth corner point to form a fifth boundary contour.

Preferably, for a seventh type of prototiles, a first boundary contour is arranged between the first corner point and the second corner point, the first boundary contour is provided with a boundary anchor point, the boundary anchor point is located outside a regular hexagon, the first boundary contour is rotated counterclockwise by 120° around the second corner point to form a second boundary contour, the second boundary contour is rotated counterclockwise by 120° around the third corner point to form a third boundary contour, the third boundary contour is rotated counterclockwise by 120° around the fourth corner point to obtain a fourth boundary contour, the fourth boundary contour is rotated counterclockwise by 120° around the fifth corner point to obtain a fifth boundary contour, and the fifth boundary contour is rotated counterclockwise by 120° around the sixth corner point to obtain a sixth boundary contour.

Preferably, the distance from the boundary anchor point to the connecting line between the first corner point and the second corner point is less than the radius of the inscribed circle of the regular hexagon.

Preferably, the prototile with the shape of an animal, plant or human figure is enclosed by the six boundary contours of the prototile, and the prototile is provided with a corresponding textured pattern of the animal, the plant or the human figure according to the shape of the animal, the plant or the human figure.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Embodiment 1

Referring to FIGS. 1-5 of the present invention, a special type of prototiles are constructed according to a periodic and nonperiodic tiling system based on regular hexagons in an embodiment of the present invention, each prototile is based on a regular hexagon structure, external contours of the prototile are composed of six boundary contours, the boundary contours can be located outside or inside a regular hexagon as required, but the areas of parts convex from and concave into the regular hexagon are correspondingly equal, so the area of the prototile is equal to that of the original regular hexagon. A specific shape of an animal, plant or human figure is enclosed by the six boundary contours, and a plurality of specific shapes enclosed by the six boundary contours are engaged with each other to form a tiling surface; the prototile is provided with a corresponding textured pattern according to the boundary contours of the specific shape.

Figure 1:
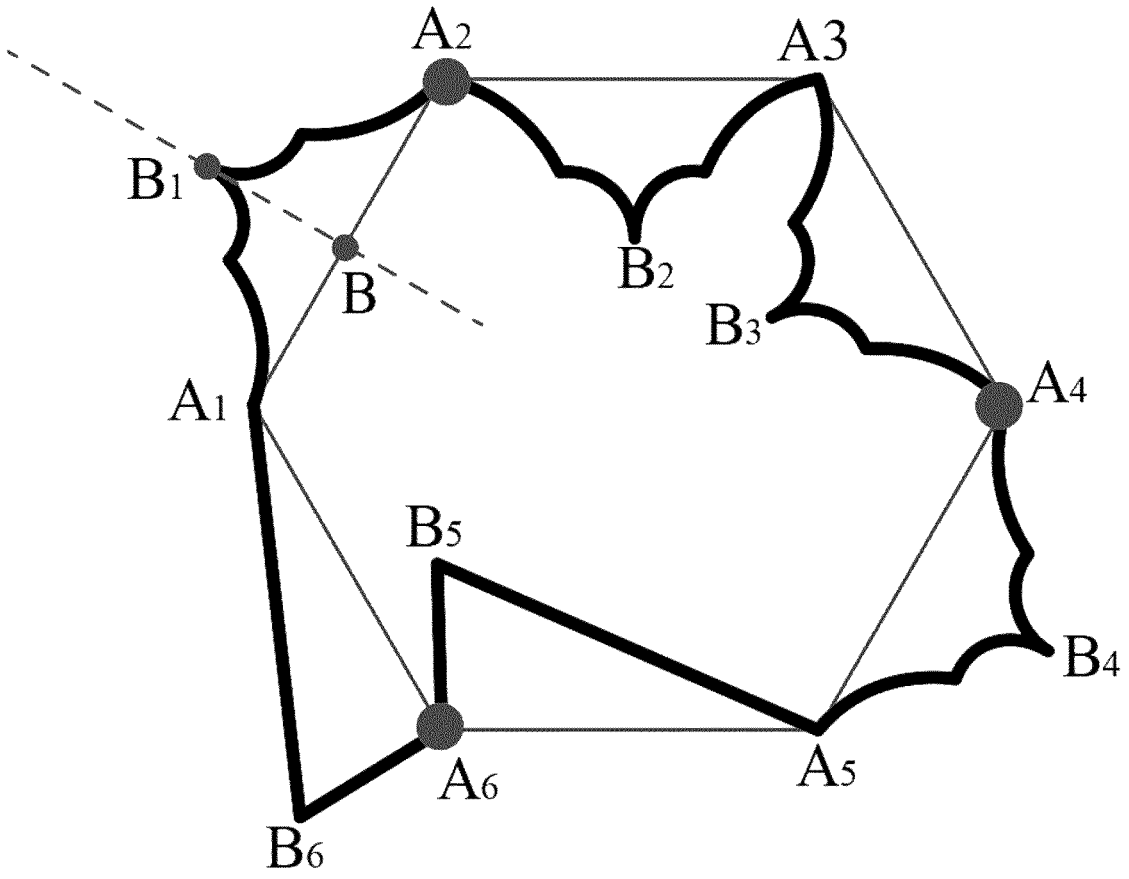
FIG. 1 is a structural schematic diagram of embodiment 1 of the present invention.
Figure 2:
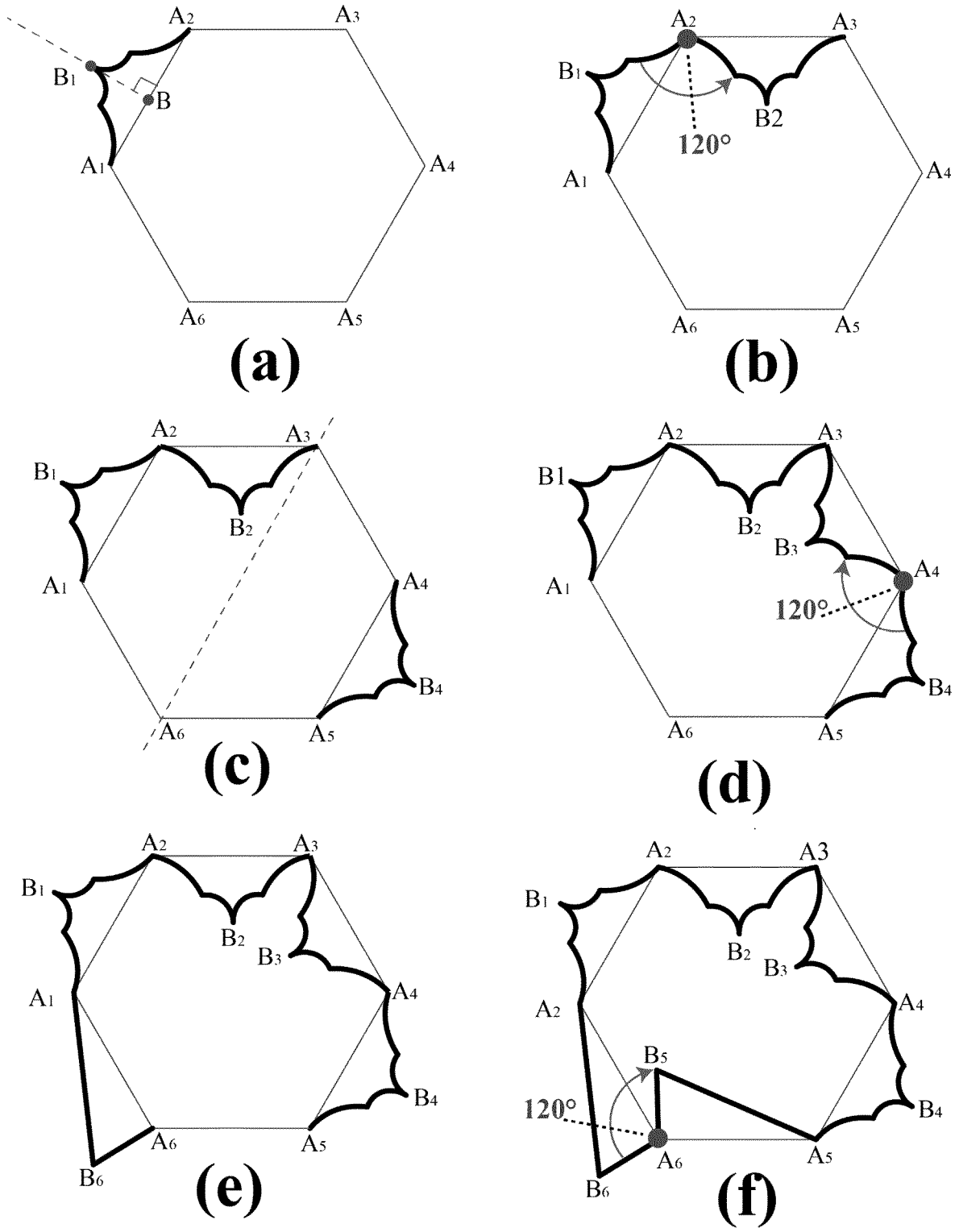
FIG. 2 shows a design flow of embodiment 1 of the present invention.
Figure 3:
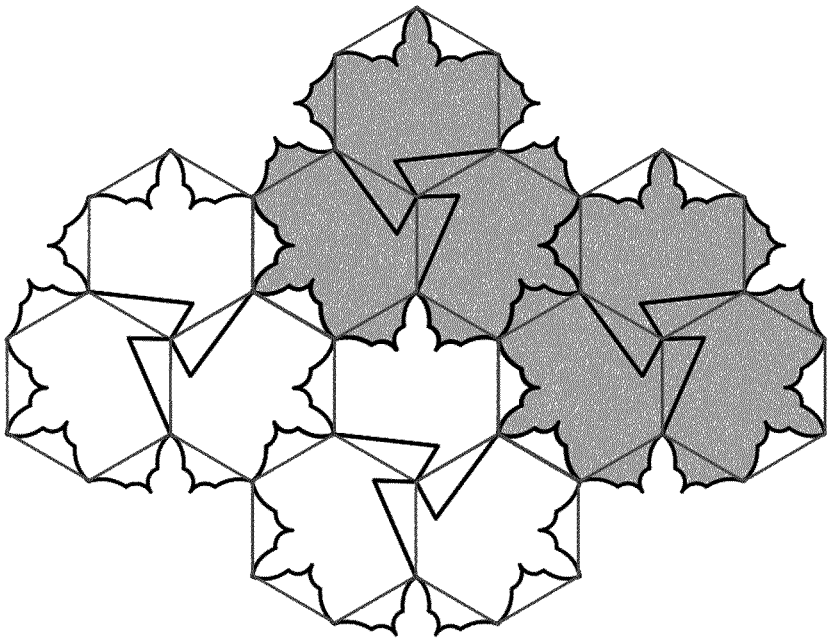
FIG. 3 is a tiling diagram of embodiment 1 of the present invention.

Specifically, each of the first type of prototiles has a first corner point A1, a second corner point A2, a third corner point A3, a fourth corner point A4, a fifth corner point A5 and a sixth corner point A6 corresponding to the regular hexagon structure, a first boundary contour is arranged between the first corner point A1 and the second corner point A2, the first boundary contour is provided with a boundary anchor point B1, the boundary anchor point B1 is located outside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the first boundary contour is mirror-symmetric about the connecting line between the third corner point A3 and the sixth corner point A6 to form a fourth boundary contour between the fourth corner point A4 and the fifth corner point A5; the fourth boundary contour is rotated clockwise by 120° around the fourth corner point A4 to form a third boundary contour between the third corner point A3 and the fourth corner point A4; a sixth boundary contour is arranged between the first corner point A1 and the sixth corner point A6, and the sixth boundary contour is rotated clockwise by 120° around the sixth corner point A6 to form a fifth boundary contour between the fifth corner point A5 and the sixth corner point A6. The process of constructing the six boundary contours by the method is shown in FIG. 1.

Figure 4:
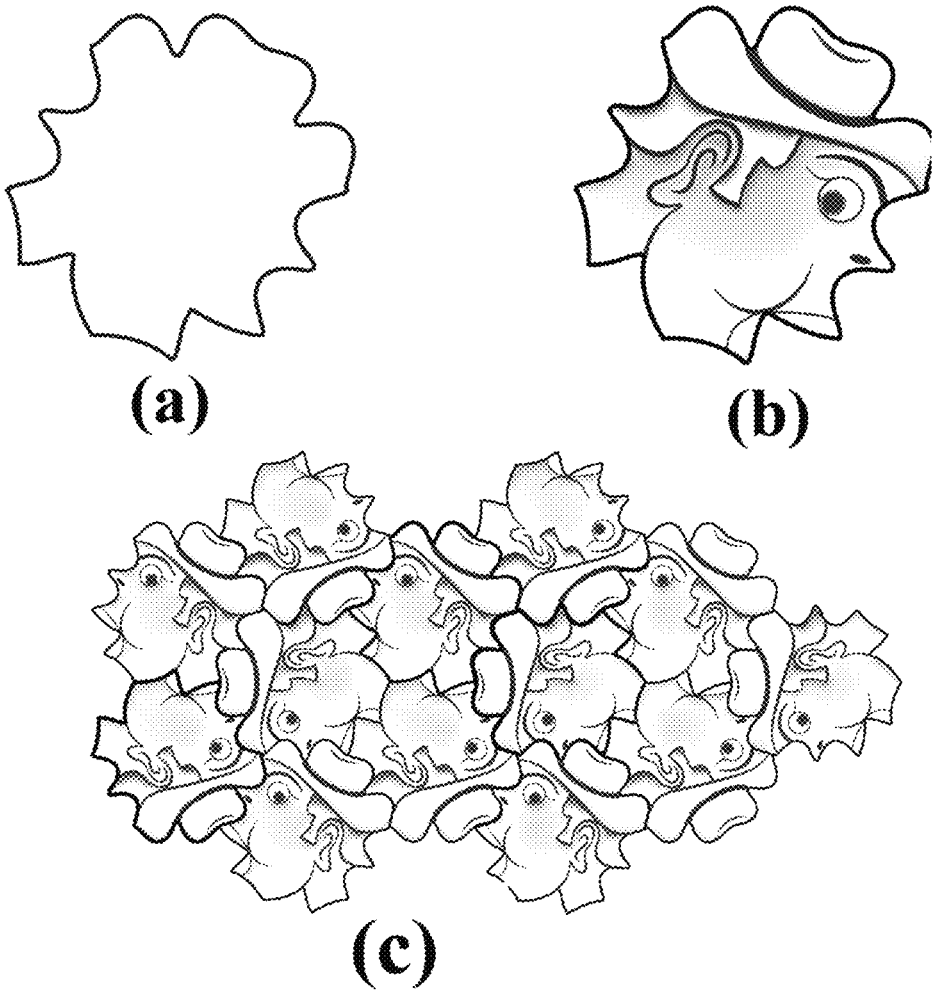
FIG. 4 is an application diagram of embodiment 1 of the present invention.

More specifically, the distance from the boundary anchor point B1 to the connecting line between the first corner point A1 and the second corner point A2 is less than the radius of the inscribed circle of the regular hexagon, thus to ensure that the six contours can only intersect at the corner points and successfully enclose a pattern, and tiling (FIG. 3) without any overlapping or gap can be constructed according to the prototile (FIG. 2) constructed by the method. If an art picture of the prototile is transformed into the shape of a human head, and an appropriate textured pattern of the head is designed, the prototile can be used to construct the art tiling of the head, as shown in FIG. 4.

Embodiment 2

Figure 5:
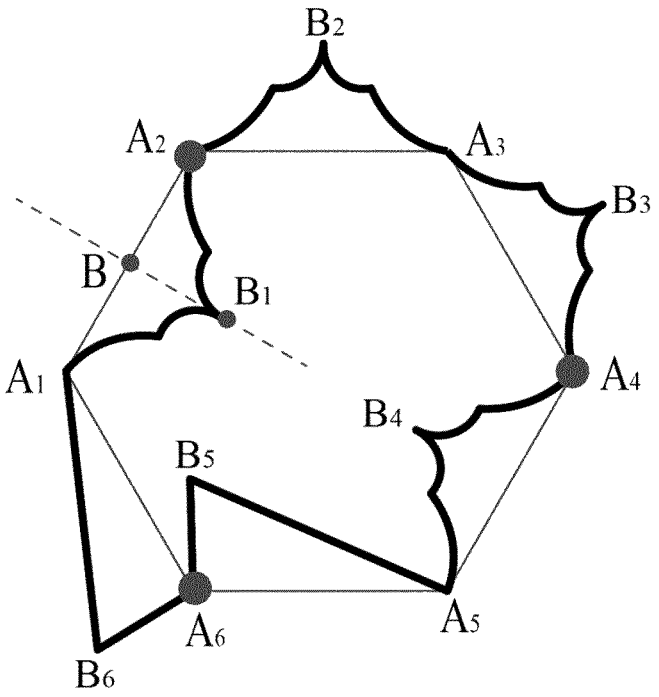
FIG. 5 is a structural diagram of embodiment 1 of the present invention.
Figure 6:
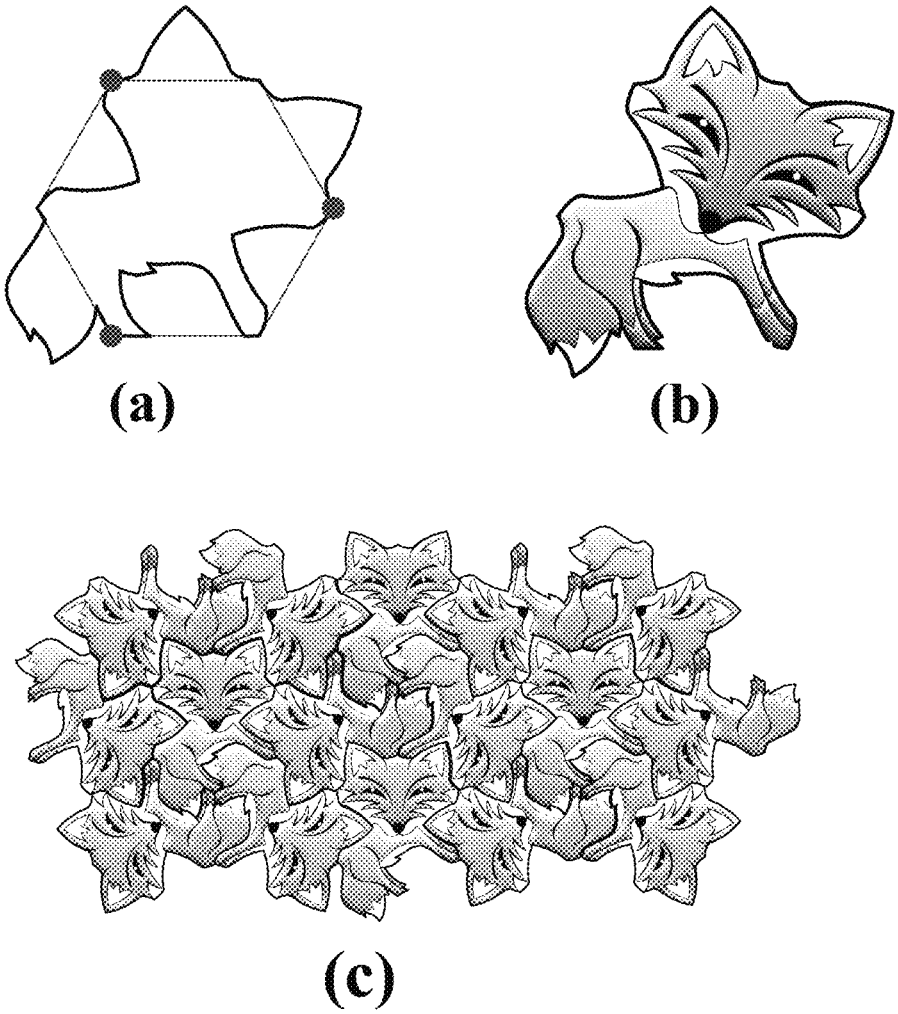
FIG. 6 is an application diagram of embodiment 2 of the present invention.

Referring to FIGS. 5-6, different from embodiment 1, the layout that parts of the boundary contours are concave into or convex from the regular hexagon is changed by setting the boundary anchor point B1 inside the regular hexagon. Specifically, each of the second type of prototiles has a first corner point A1, a second corner point A2, a third corner point A3, a fourth corner point A4, a fifth corner point A5 and a sixth corner point A6 corresponding to the regular hexagon structure, a first boundary contour is arranged between the first corner point A1 and the second corner point A2, the first boundary contour is provided with a boundary anchor point B1, the boundary anchor point B1 is located inside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the first boundary contour is mirror-symmetric about the connecting line between the third corner point A3 and the sixth corner point A6 to form a fourth boundary contour between the fourth corner point A4 and the fifth corner point A5; the fourth boundary contour is rotated clockwise by 120° around the fourth corner point A4 to form a third boundary contour between the third corner point A3 and the fourth corner point A4; a sixth boundary contour is arranged between the first corner point A1 and the sixth corner point A6, and the sixth boundary contour is rotated clockwise by 120° around the sixth corner point A6 to form a fifth boundary contour between the fifth corner point A5 and the sixth corner point A6. An example of a prototile constructed by the method is shown in FIG. 5. According to the method, a contour diagram of the prototile with the shape of a fox can be designed, and an appropriate textured pattern of the fox can be designed to construct the art tiling of the pattern of the fox, as shown in FIG. 6.

Embodiment 3

Figure 7:
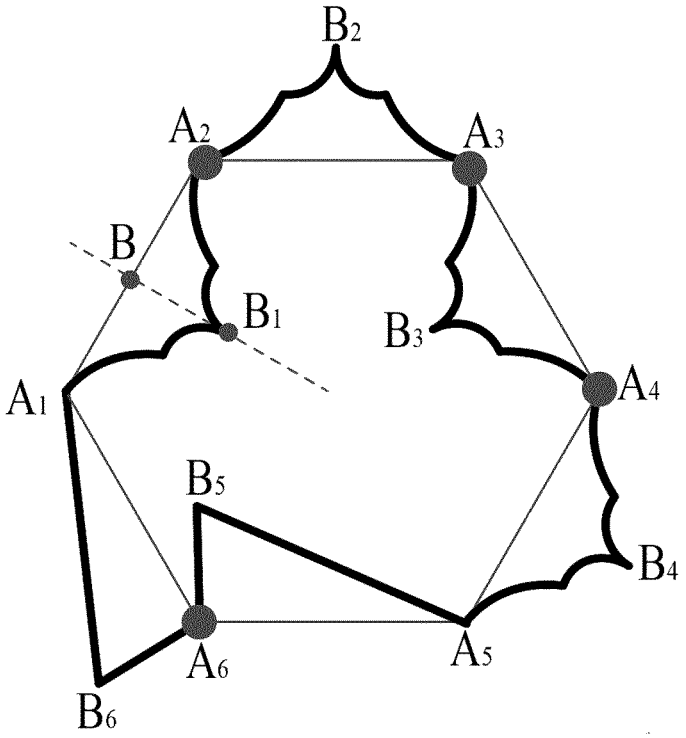
FIG. 7 is a structural diagram of embodiment 3 of the present invention.
Figure 8:
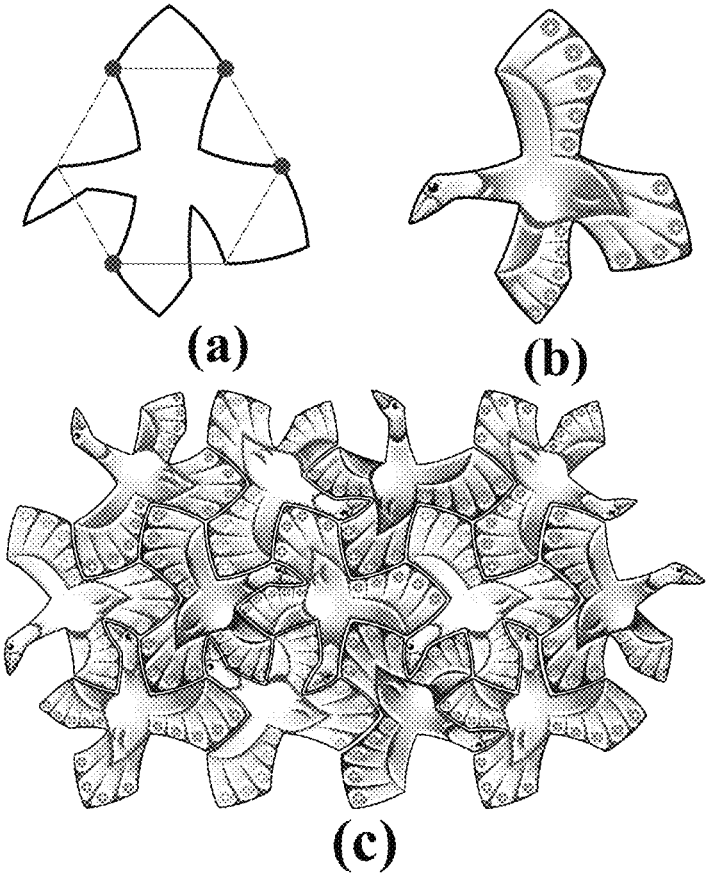
FIG. 8 is an application diagram of embodiment 3 of the present invention.
Figure 9:
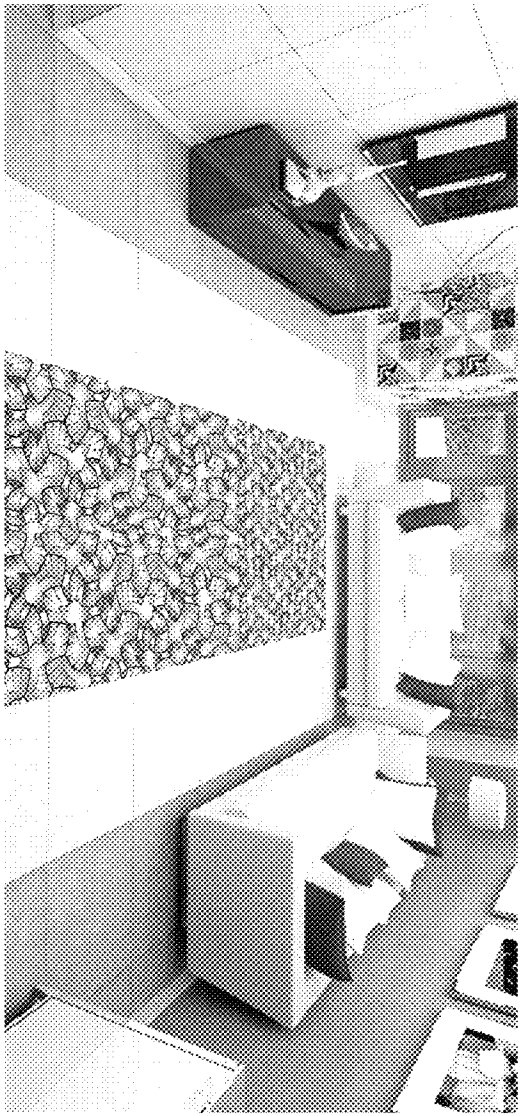
FIG. 9 is a scene decoration diagram of embodiment 3 of the present invention.

Referring to FIGS. 7-8, specifically, each of the third type of prototiles has a first corner point A1, a second corner point A2, a third corner point A3, a fourth corner point A4, a fifth corner point A5 and a sixth corner point A6 corresponding to the regular hexagon structure, a first boundary contour is arranged between the first corner point A1 and the second corner point A2, a boundary anchor point B1 of the first boundary contour is located inside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the second boundary contour is rotated counterclockwise by 120° around the third corner point A3 to form a third boundary contour between the third corner point A3 and the fourth corner point A4; the third boundary contour is rotated counterclockwise by 120° around the fourth corner point A4 to form a fourth boundary contour between the fourth corner point A4 and the fifth corner point A5; a sixth boundary contour is arranged between the first corner point A1 and the sixth corner point A6, and the sixth boundary contour is rotated clockwise by 120° around the sixth corner point A6 to form a fifth boundary contour between the fifth corner point A5 and the sixth corner point A6. An example of a prototile constructed by the method is shown in FIG. 7. According to the method, an art contour diagram of the prototile with the shape of a bird can be designed, and the art tiling of the pattern of the bird can be constructed, as shown in FIG. 8. The constructed bird tiling can be used for home decoration, as shown in FIG. 9.

Embodiment 4

Figure 10:
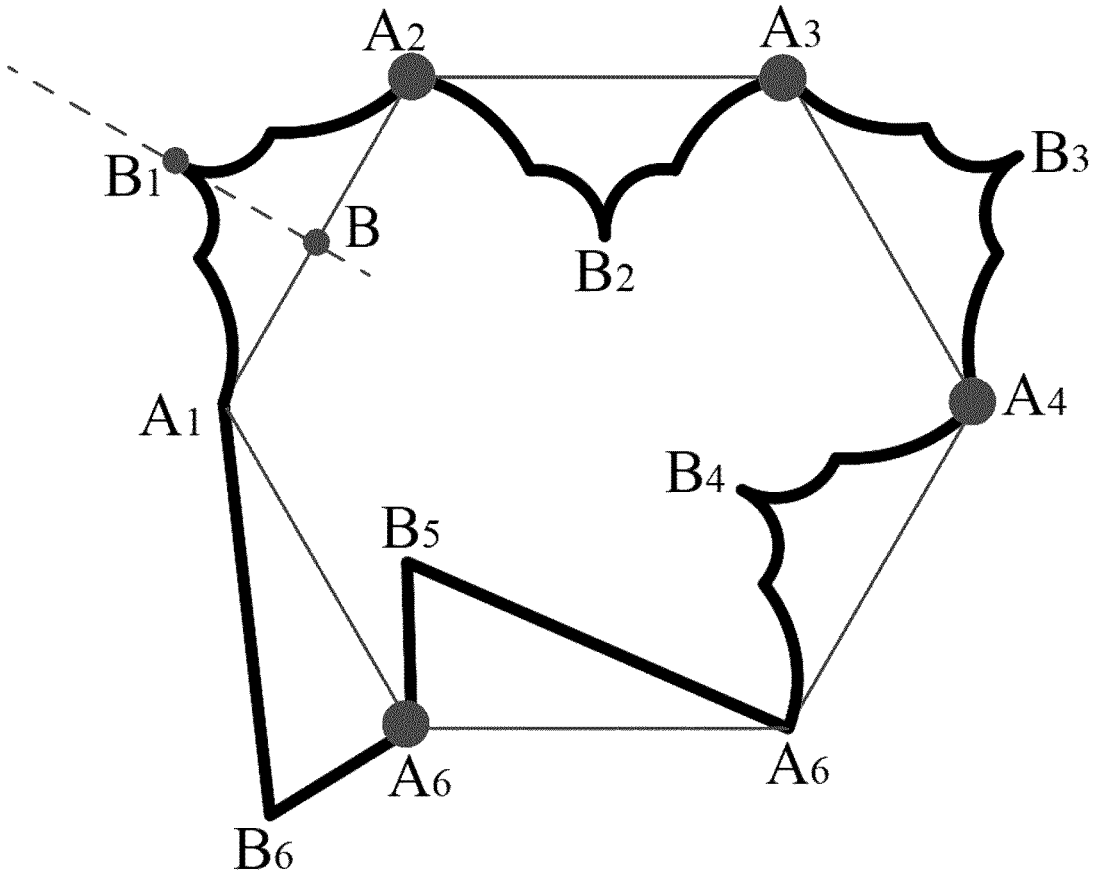
FIG. 10 is a structural diagram of embodiment 4 of the present invention.
Figure 11:
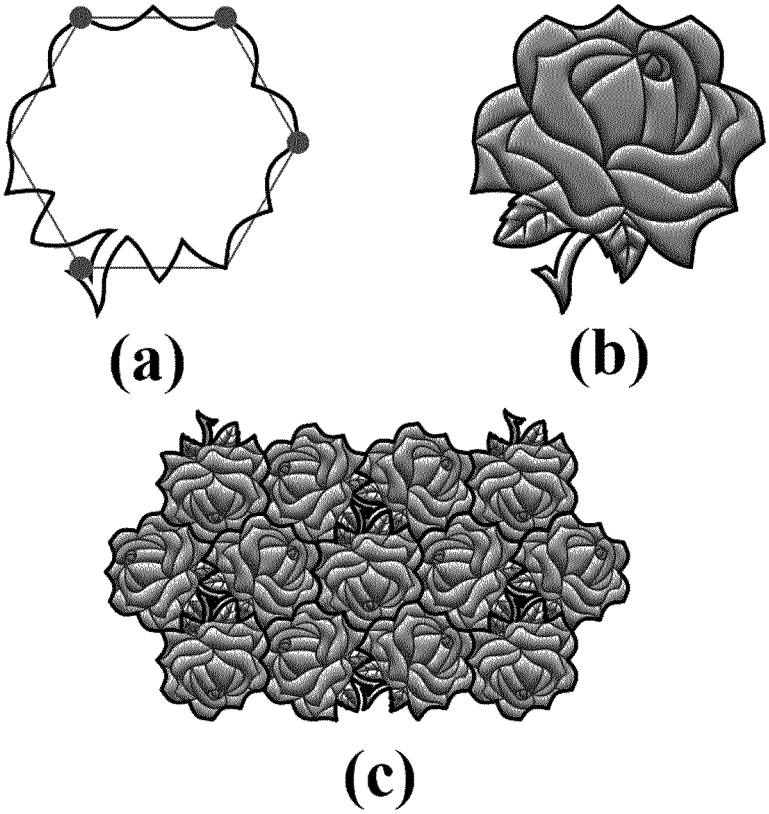
FIG. 11 is an application diagram of embodiment 4 of the present invention.

Referring to FIGS. 10-11, different from embodiment 3, the layout that parts of the boundary contours are concave into or convex from the regular hexagon is changed by setting the boundary anchor point B1 outside the regular hexagon. Specifically, each of the fourth type of prototiles has a first corner point A1, a second corner point A2, a third corner point A3, a fourth corner point A4, a fifth corner point A5 and a sixth corner point A6 corresponding to the regular hexagon structure, a first boundary contour is arranged between the first corner point A1 and the second corner point A2, a boundary anchor point B1 of the first boundary contour is located outside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the second boundary contour is rotated counterclockwise by 120° around the third corner point A3 to form a third boundary contour between the third corner point A3 and the fourth corner point A4; the third boundary contour is rotated counterclockwise by 120° around the fourth corner point A4 to form a fourth boundary contour between the fourth corner point A4 and the fifth corner point A5; a sixth boundary contour is arranged between the first corner point A1 and the sixth corner point A6, and the sixth boundary contour is rotated clockwise by 120° around the sixth corner point A6 to form a fifth boundary contour between the fifth corner point A5 and the sixth corner point A6. An example of a prototile constructed by the method is shown in FIG. 10. According to the method, an art contour diagram of the prototile with the shape of a rose and a textured pattern thereof can be designed, and the art tiling of the pattern of the rose can be constructed, as shown in FIG. 11.

Embodiment 5

Figure 12:
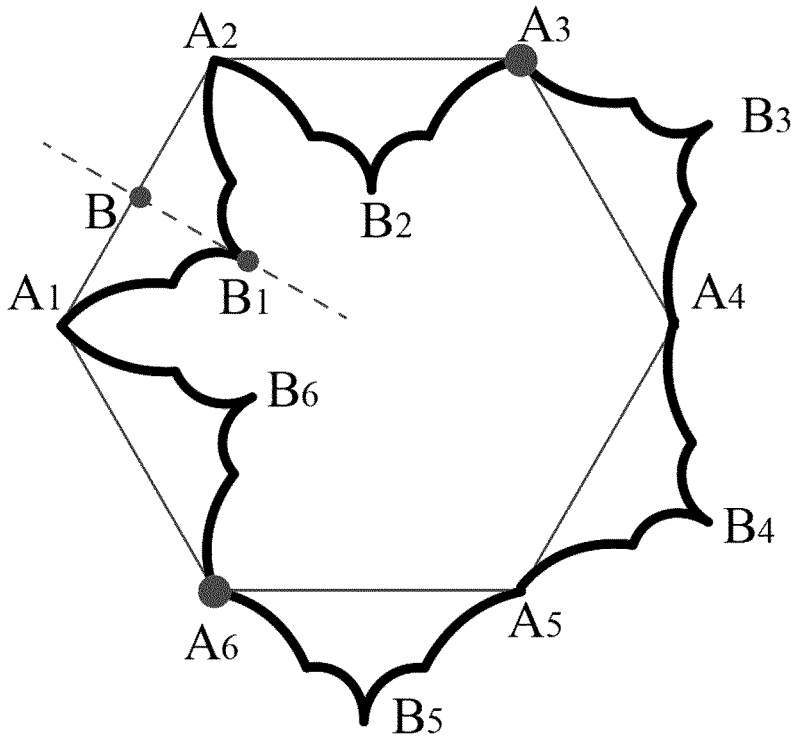
FIG. 12 is a structural diagram of embodiment 5 of the present invention.
Figure 13:
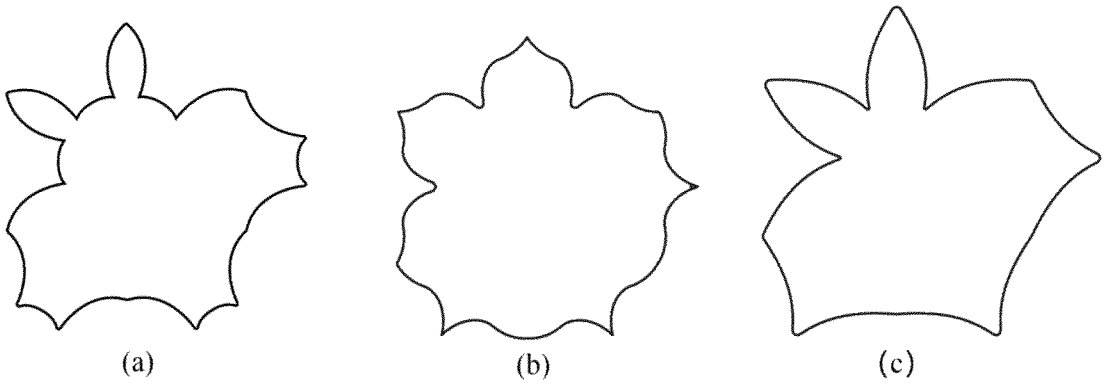
FIG. 13 is a diagram of specific shapes of the present invention formed based on a variation mode of embodiment 5.
Figure 14:
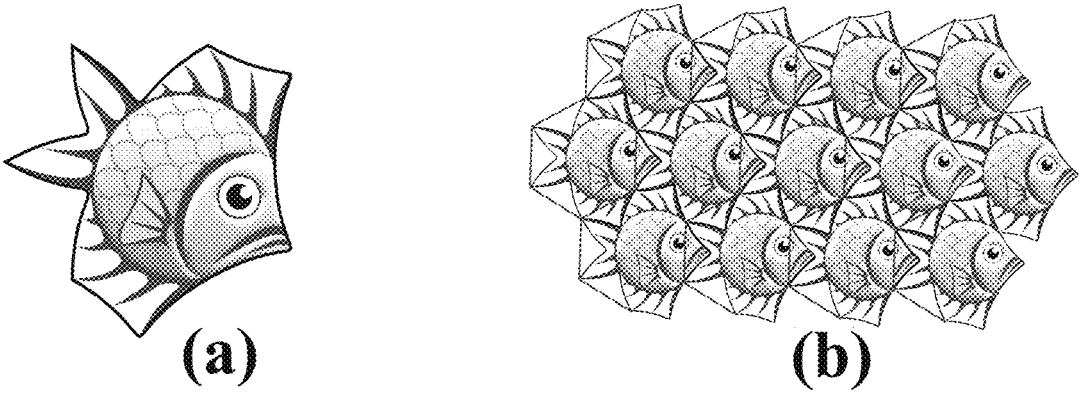
FIG. 14 is an application diagram of embodiment 5 of the present invention.
Figure 15:
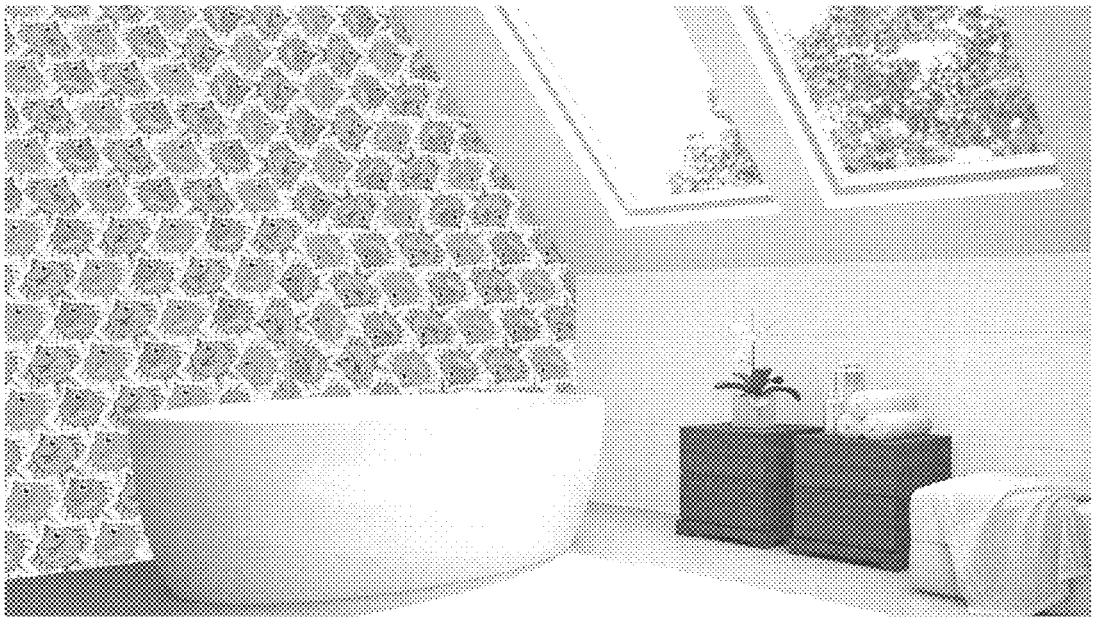
FIG. 15 is a scene decoration diagram of embodiment 5 of the present invention.

Referring to FIGS. 12-13, specifically, each of the fifth type of prototiles has a first corner point A1, a second corner point A2, a third corner point A3, a fourth corner point A4, a fifth corner point A5 and a sixth corner point A6 corresponding to the regular hexagon structure, a first boundary contour is arranged between the first corner point A1 and the second corner point A2, a boundary anchor point B1 of the first boundary contour is located inside a regular hexagon A1A2A3A4A5A6, and the first boundary contour is symmetric about the perpendicular bisector BB1 of the connecting line between the first corner point A1 and the second corner point A2; a second boundary contour which is in the same state as the first boundary contour is arranged between the second corner point A2 and the third corner point A3, and a sixth boundary contour which is in the same state as the first boundary contour is arranged between the first corner point A1 and the sixth corner point A6; the second boundary contour is rotated counterclockwise by 120° around the third corner point A3 to form a third boundary contour between the third corner point A3 and the fourth corner point A4; the sixth boundary contour is rotated clockwise by 120° around the sixth corner point A6 to form a fifth boundary contour between the fifth corner point A5 and the sixth corner point A6; and a fourth boundary contour which is in the same state as the third boundary contour is arranged between the fourth corner point A4 and the fifth corner point A5. An example of a prototile constructed by the method is shown in FIG. 12. According to the method, a variety kinds of contours of the prototile can be designed, and examples of the contours of the prototile with the shape of an animal and a plant are shown in FIG. 13. A textured pattern can be designed in the contours of the prototile with the shape of a fish, and the art tiling of the pattern of the fish can be constructed, as shown in FIG. 14. The fish tiling can be used for home decoration, as shown in FIG. 15.

Embodiment 6

Referring to FIGS. 16-19, specifically, each prototile has a first corner point A1, a second corner point A2, a third corner point A3, a fourth corner point A4, a fifth corner point A5 and a sixth corner point A6 corresponding to the regular hexagon structure, an external boundary contour is arranged between the first corner point A1 and the second corner point A2, a boundary anchor point B1 of a first boundary contour is located inside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the second boundary contour is rotated counterclockwise by 120° around the third corner point A3 to form a third boundary contour between the third corner point A3 and the fourth corner point A4; the third boundary contour is rotated counterclockwise by 120° around the fourth corner point A4 to form a fourth boundary contour between the fourth corner point A4 and the fifth corner point A5; the third boundary contour is minor-symmetric about the connecting line between the second corner point A2 and the fifth corner point A5 to form a sixth boundary contour between the first corner point A1 and the sixth corner point A6; and the sixth boundary contour is rotated clockwise by 120° around the sixth corner point A6 to form a fifth boundary contour between the fifth corner point A5 and the sixth corner point A6.

Figure 16:
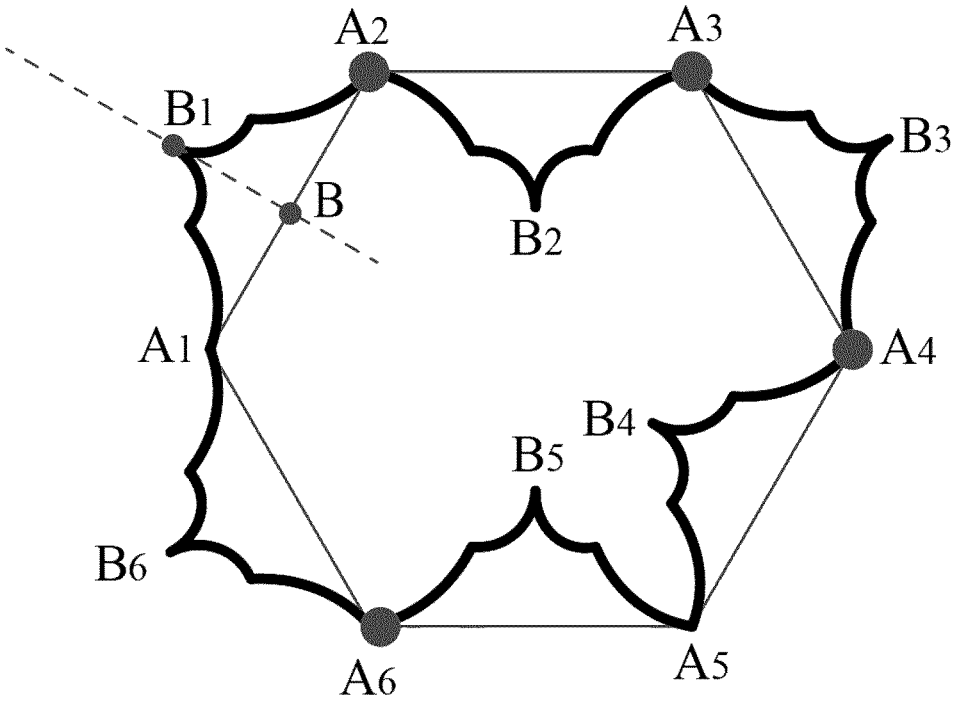
FIG. 16 is a structural diagram of embodiment 6 of the present invention.
Figure 17:
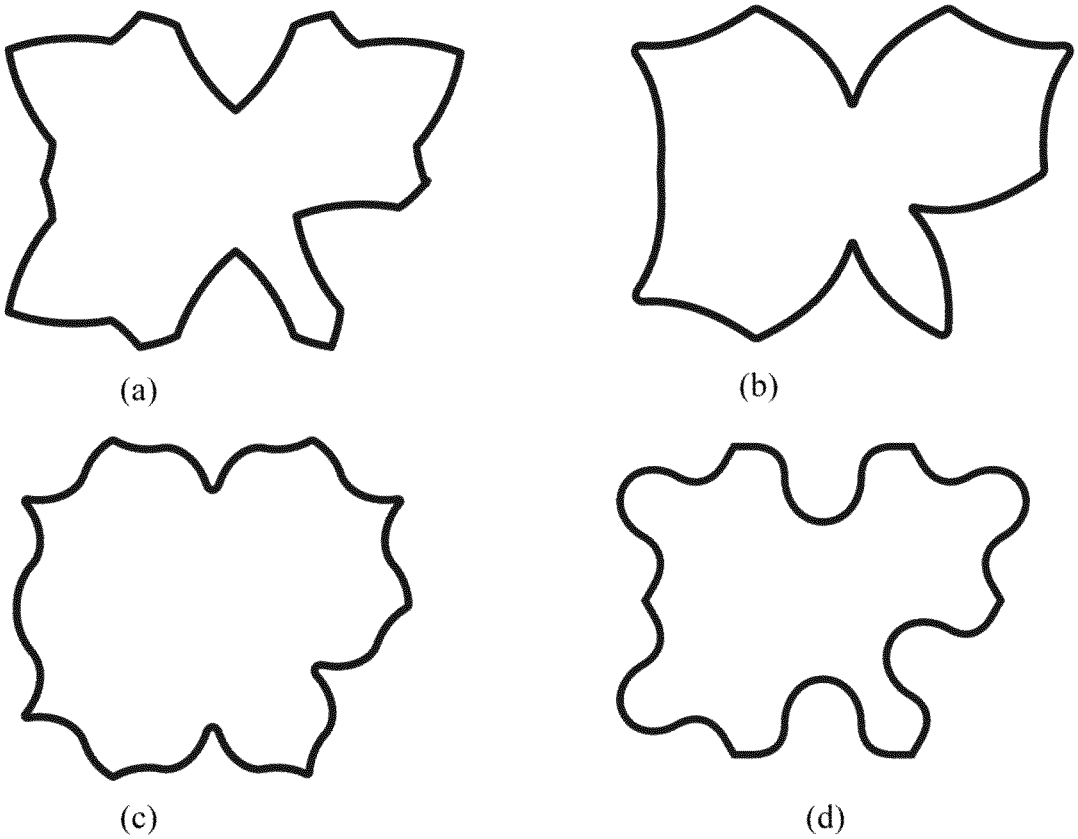
FIG. 17 is a diagram of specific shapes of the present invention formed based on a variation mode of embodiment 6.
Figure 18:
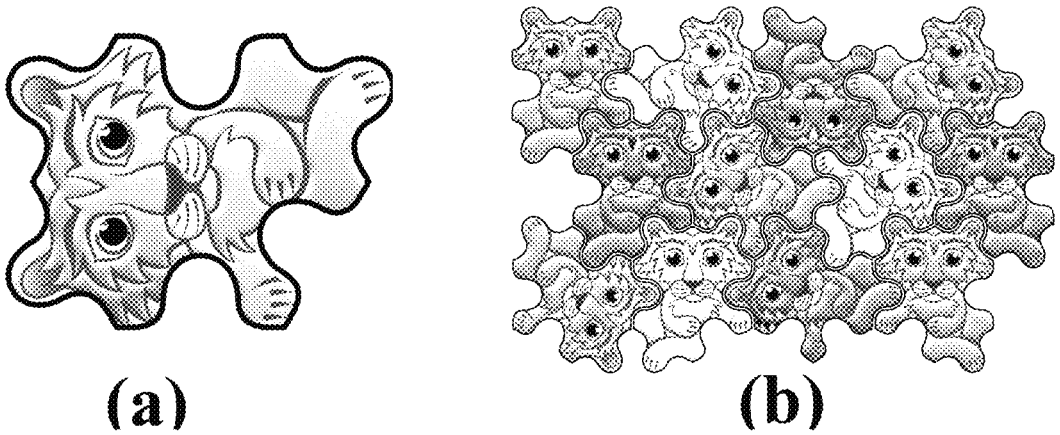
FIG. 18 is an application diagram of embodiment 6 of the present invention.
Figure 19:
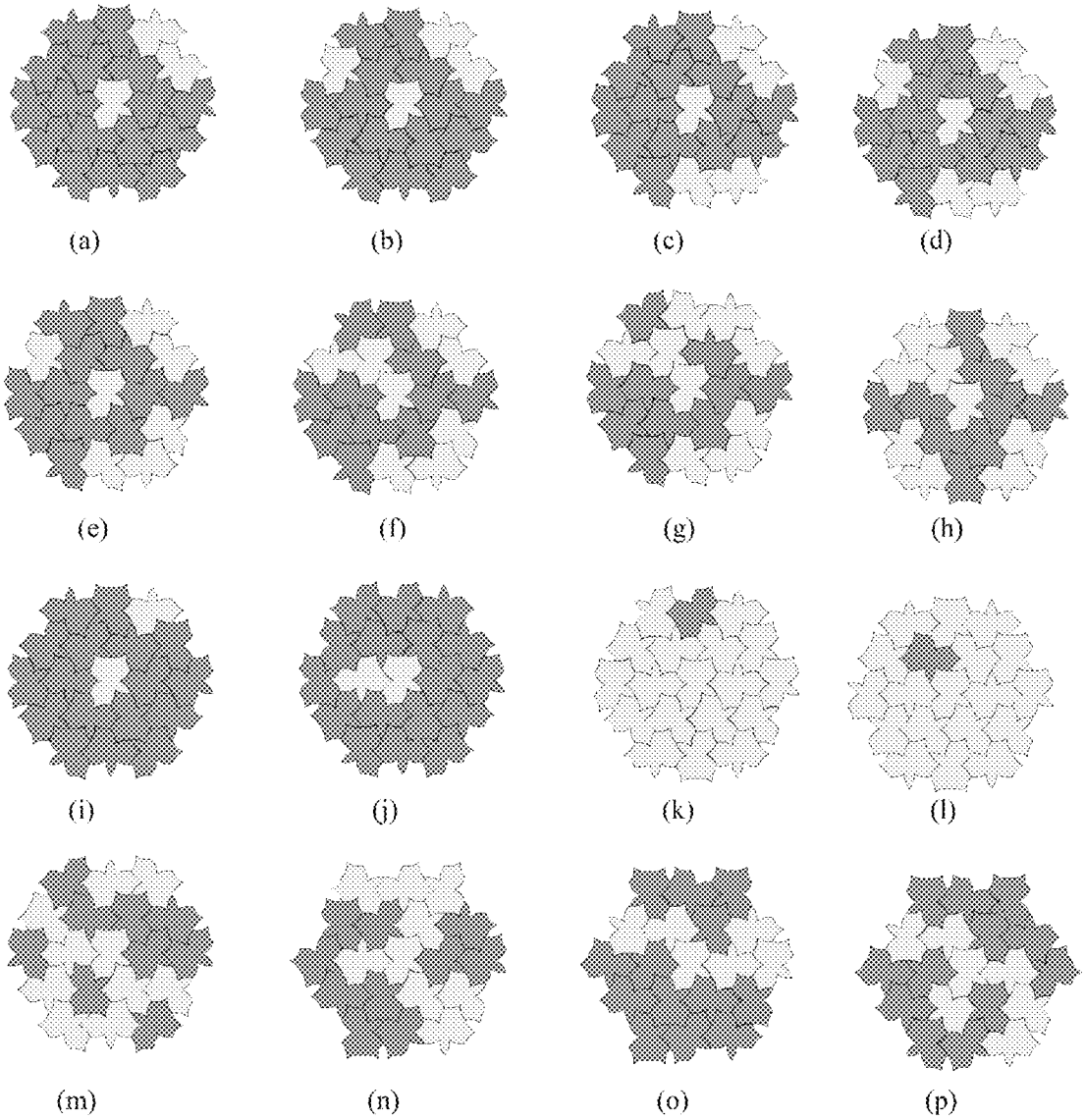
FIG. 19 is a schematic diagram of examples of a variety types of tiling constructed in embodiment 6 of the present invention.

An example of a prototile constructed by the method is shown in FIG. 16. According to the method, the contours of the prototile with the shape of an animal, plant or human figure can be designed, and four examples are given in FIG. 17. Especially, by designing a textured pattern in the contours of the prototile with the shape of a lion, the art tiling of the pattern of the lion can be constructed, as shown in FIG. 18. The contours of the prototile designed by the method can be used to construct a variety types of tiling, and 16 examples of local tiling are shown in FIG. 19.

Embodiment 7

Figure 20:
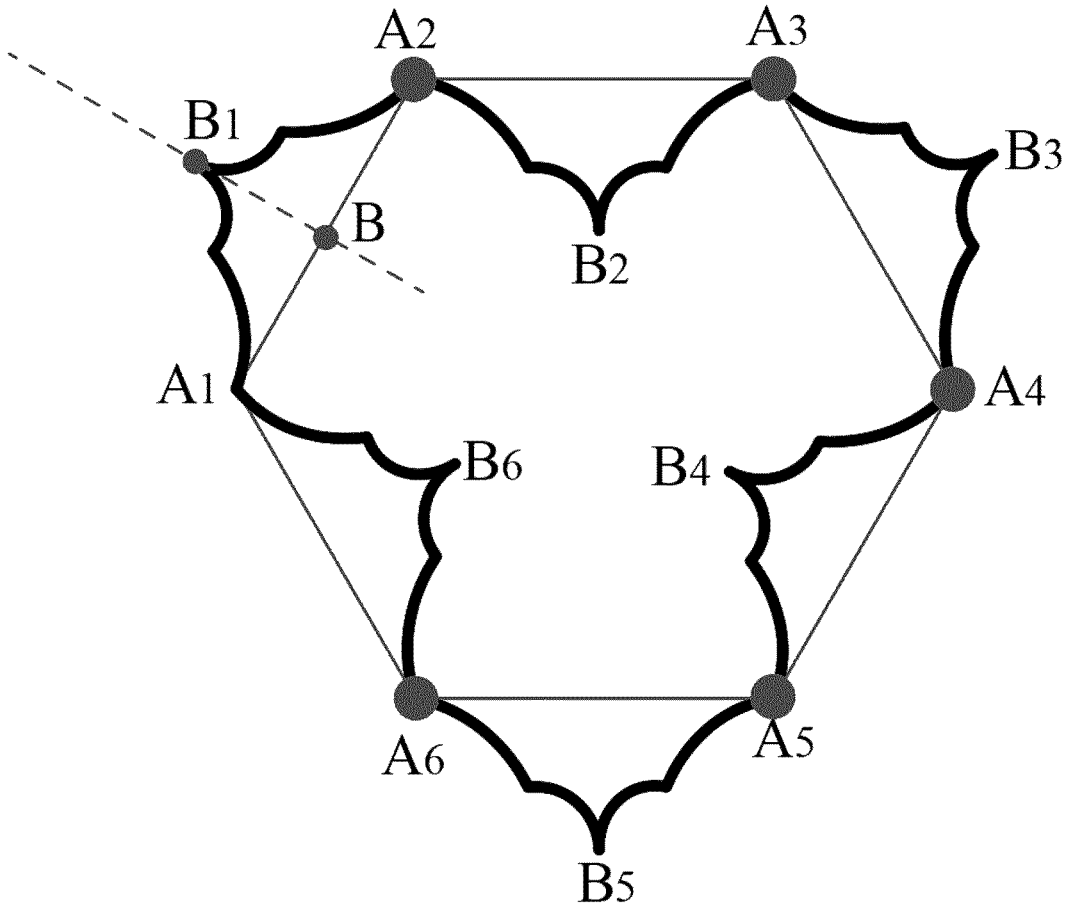
FIG. 20 is a structural diagram of embodiment 7 of the present invention.
Figure 21:
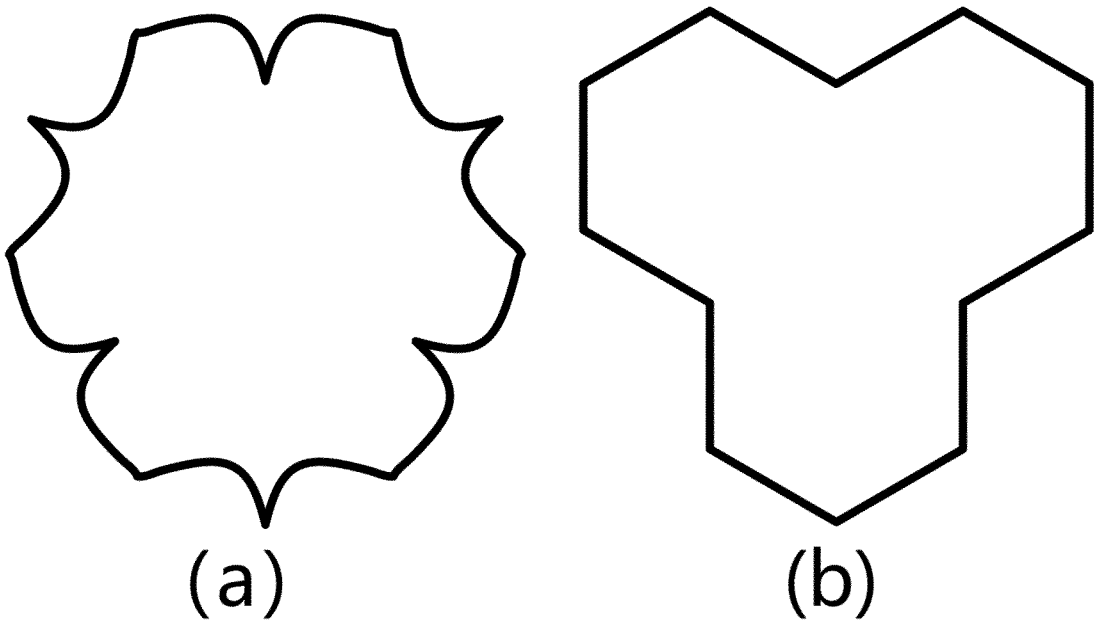
FIG. 21 is a diagram of specific shapes of the present invention formed based on a variation mode of embodiment 7.
Figure 22:
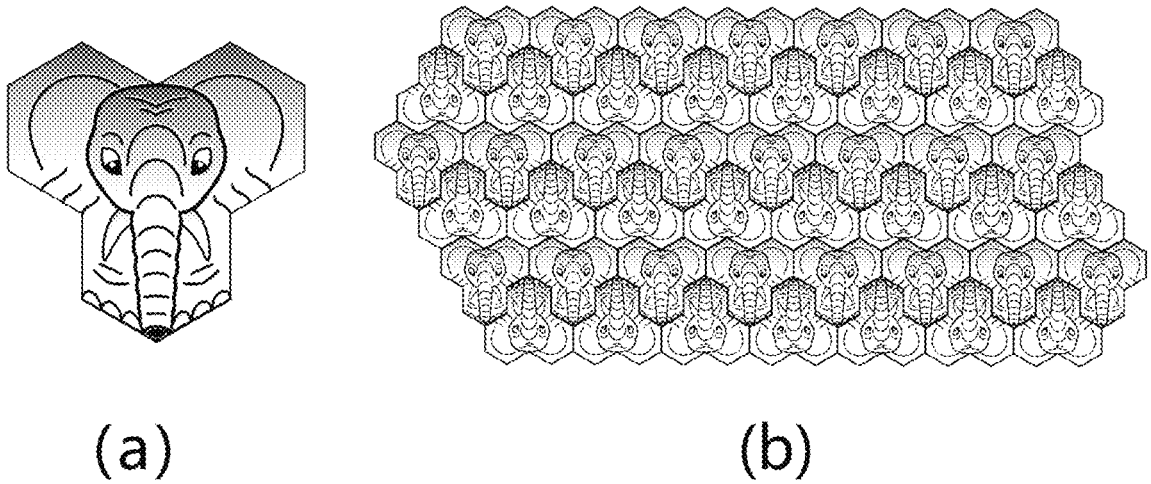
FIG. 22 is an application diagram of embodiment 7 of the present invention.

Referring to FIGS. 20-22, specifically, each prototile has a first corner point A1, a second corner point A2, a third corner point A3, a fourth corner point A4, a fifth corner point A5 and a sixth corner point A6 corresponding to the regular hexagon structure, an external boundary contour is arranged between the first corner point A1 and the second corner point A2, a boundary anchor point B1 of a first boundary contour is located inside a regular hexagon A1A2A3A4A5A6, and the first boundary contour is symmetric about the perpendicular bisector BB1 of the connecting line between the first corner point A1 and the second corner point A2; the first boundary contour is rotated counterclockwise by 120° around the second corner point A2 to form a second boundary contour between the second corner point A2 and the third corner point A3; the second boundary contour is rotated counterclockwise by 120° around the third corner point A3 to form a third boundary contour between the third corner point A3 and the fourth corner point A4; the third boundary contour is rotated counterclockwise by 120° around the fourth corner point A4 to form a fourth boundary contour between the fourth corner point A4 and the fifth corner point A5; the fourth boundary contour is rotated counterclockwise by 120° around the fifth corner point A5 to form a fifth boundary contour between the fifth corner point A5 and the sixth corner point A6; and the fifth boundary contour is rotated counterclockwise by 120° around the sixth corner point A6 to form a sixth boundary contour between the sixth corner point A6 and the first corner point A1. An example of a prototile constructed by the method is shown in FIG. 18. According to the method, a variety kinds of contours of the prototile can be designed, and examples of the contours of the prototile with the shapes of a flower and an elephant are shown in FIG. 21. Especially, by designing an appropriate textured pattern in the contours of the prototile with the shape of an elephant, the art tiling of the pattern of the elephant can be constructed, as shown in FIG. 22.

The transformation of the regular hexagon boundary contours in embodiments 1-7 must ensure that the area is constant, thus to achieve periodic or nonperiodic tiling. A designer can consciously design the contours of the prototile that corresponds to an animal, plant or human figure according to specific needs, that is, in the condition that a construction process which is the same as that in embodiments 1-7 is followed, prototiles with different contours can be constructed by designing different boundary contours, as shown in the examples given in FIG. 13, FIG. 17 and FIG. 21. Another outstanding advantage of the present invention is that a variety types of tiling can be constructed using one type of prototiles, as shown in FIG. 19.

To sum up, the present invention has the following five outstanding advantages over the traditional tiling: first, the traditional tiling requires the cooperation of a plurality of prototiles to form complex and rich styles of tiling, whereas the present invention only requires one type of prototiles to realize complex tiling, which greatly simplifies the manufacturing process and reduces the production cost; second, the prototiles of the traditional tiling have relatively simple structures, most of which only allow periodic tiling, whereas the prototiles disclosed by the present invention can be used to construct both periodic tiling and nonperiodic tiling; third, most traditional prototiles only allow to construct a limited number of tiling structures, whereas the prototiles disclosed by the present invention allow splicing in a variety modes and can be used to construct tiling with tens of thousands of different structures, the types of tiling structures are much more than those of the traditional tiling, and the prototiles disclosed by the present invention are especially suitable for the construction of a system with a high structural complexity; fourth, the splicing modes allowed by the traditional prototiles is definite, so the splicing difficulty is low, whereas the prototiles disclosed by the present invention allow a plurality of splicing possibilities, which can derive a large number of false splicing possibilities that meet the requirements of local tiling but not global tiling, so the splicing difficulty will be increased sharply along with the increase of the tiling scale; fifth, the shape of the prototiles of the traditional tiling cannot be changed, and the boundaries thereof are fixed in shape, whereas the boundaries of the prototiles disclosed by the present invention can be transformed freely within the framework of construction criteria, which makes the present invention have an outstanding potential of artistic design and have a broad market application prospect.

For a device and a use method disclosed by the embodiments, because the device and the use method correspond to a method disclosed by the embodiments, the device and the use method are simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

The invention claimed is:

1. A periodic and nonperiodic tiling system based on regular hexagons, comprising a plurality of prototiles, the prototiles are each based on a regular hexagon structure, each prototile has a first corner point, a second corner point, a third corner point, a fourth corner point, a fifth corner point and a sixth corner point corresponding to the regular hexagon structure, and a boundary contour is arranged between any adjacent two of the first corner point, the second corner point, the third corner point, the fourth corner point, the fifth corner point and the sixth corner point; in boundary contours corresponding to the prototile, areas of parts convex from and concave into each of the regular hexagons are equal, a contour edge with a specific shape is formed by the boundary contours on the prototile, and the contour edge with the specific shape of each prototile is engaged with contour edges with the specific shape of prototiles adjacent to the prototile to form a periodic tiling system or a nonperiodic tiling system; a specific shape of an animal, plant or human figure is jointly formed by the boundary contours on the prototile, and the prototile is provided with a textured pattern corresponding to the boundary contours of the specific shape, wherein a first boundary contour is arranged between the first corner point and the second corner point, the first boundary contour is provided with a boundary anchor point, the boundary anchor point is located outside a regular hexagon, the boundary anchor point is located on the perpendicular bisector of a connecting line between the first corner point and the second corner point, the first boundary contour is symmetric about the perpendicular bisector of the connecting line between the first corner point and the second corner point, a second boundary contour is provided to overlap with a boundary contour obtained by rotating the first boundary contour counterclockwise by 120° around the second corner point, a center line is formed by a connecting line between the third corner point and the sixth corner point, the first boundary contour and a fourth boundary contour are mirror-symmetric about the center line, a third boundary contour is provided to overlap with a boundary contour obtained by rotating the fourth boundary contour clockwise by 120° around the fourth corner point, a sixth boundary contour is arranged between the first corner point and the sixth corner point, a fifth boundary contour is provided to overlap with a boundary contour obtained by rotating the sixth boundary contour clockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located inside a regular hexagon, the first boundary contour is symmetric about the perpendicular bisector of a connecting line between the first corner point and the second corner point, a second boundary contour is provided to overlap with a boundary contour obtained by rotating the first boundary contour counterclockwise by 120° around the second corner point, the first boundary contour and a fourth boundary contour are mirror-symmetric about a connecting line between the third corner point and the sixth corner point, a third boundary contour is provided to overlap with a boundary contour obtained by rotating the fourth boundary contour clockwise by 120° around the fourth corner point, a sixth boundary contour is arranged between the first corner point and the sixth corner point, a fifth boundary contour is provided to overlap with a boundary contour obtained by rotating the sixth boundary contour clockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located inside a regular hexagon, the first boundary contour is symmetric about the perpendicular bisector of a connecting line between the first corner point and the second corner point, a second boundary contour is provided to overlap with a boundary contour obtained by rotating the first boundary contour counterclockwise by 120° around the second corner point, a third boundary contour is provided to overlap with a boundary contour obtained by rotating the second boundary contour counterclockwise by 120° around the third corner point, a fourth boundary contour is provided to overlap with a boundary contour obtained by rotating the third boundary contour counterclockwise by 120° around the fourth corner point, a sixth boundary contour is arranged between the first corner point and the sixth corner point, a fifth boundary contour is provided to overlap with a boundary contour obtained by rotating the sixth boundary contour clockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located outside a regular hexagon, the first boundary contour is symmetric about the perpendicular bisector of a connecting line between the first corner point and the second corner point, a second boundary contour is provided to overlap with a boundary contour obtained by rotating the first boundary contour counterclockwise by 120° around the second corner point, a third boundary contour is provided to overlap with a boundary contour obtained by rotating the second boundary contour counterclockwise by 120° around the third corner point, a fourth boundary contour is provided to overlap with a boundary contour obtained by rotating the third boundary contour counterclockwise by 120° around the fourth corner point, a sixth boundary contour is arranged between the first corner point and the sixth corner point, a fifth boundary contour is provided to overlap with a boundary contour obtained by rotating the sixth boundary contour clockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located inside a regular hexagon, the first boundary contour is symmetric about the perpendicular bisector of a connecting line between the first corner point and the second corner point, a second boundary contour which is in the same state as the first boundary contour is arranged between the second corner point and the third corner point, and a sixth boundary contour which is in the same state as the first boundary contour is arranged between the first corner point and the sixth corner point; a third boundary contour is provided to overlap with a boundary contour obtained by rotating the second boundary contour counterclockwise by 120° around the third corner point, a fourth boundary contour which is in the same state as the third boundary contour is arranged between the fourth corner point and the fifth corner point, a fifth boundary contour which is in the same state as the fourth boundary contour is arranged between the fifth corner point and the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located outside a regular hexagon, the first boundary contour is symmetric about the perpendicular bisector of a connecting line between the first corner point and the second corner point, a second boundary contour is provided to overlap with a boundary contour obtained by rotating the first boundary contour counterclockwise by 120° around the second corner point, a third boundary contour is provided to overlap with a boundary contour obtained by rotating the second boundary contour counterclockwise by 120° around the third corner point, a fourth boundary contour is provided to overlap with a boundary contour obtained by rotating the third boundary contour counterclockwise by 120° around the fourth corner point, the third boundary contour and a sixth boundary contour are mirror-symmetric about a connecting line between the second corner point and the fifth corner point, a fifth boundary contour is provided to overlap with a boundary contour obtained by rotating the sixth boundary contour clockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure; or wherein a first boundary contour is arranged between the first corner point and the second corner point, the first boundary contour is provided with a boundary anchor point, the boundary anchor point is located outside a regular hexagon, a second boundary contour is provided to overlap with a boundary contour obtained by rotating the first boundary contour counterclockwise by 120° around the second corner point, a third boundary contour is provided to overlap with a boundary contour obtained by rotating the second boundary contour counterclockwise by 120° around the third corner point, a fourth boundary contour is provided to overlap with a boundary contour obtained by rotating the third boundary contour counterclockwise by 120° around the fourth corner point, a fifth boundary contour is provided to overlap with a boundary contour obtained by rotating the fourth boundary contour is rotated counterclockwise by 120° around the fifth corner point, a sixth boundary contour is provided to overlap with a boundary contour obtained by rotating the fifth boundary contour is rotated counterclockwise by 120° around the sixth corner point, the first boundary contour, the second boundary contour, the third boundary contour, the fourth boundary contour, the fifth boundary contour and the sixth boundary contour are connected end to end to form a simply connected region, the first boundary contour, the second boundary contour, the third boundary contour, the fourth boundary contour, the fifth boundary contour and the sixth boundary contour together form a shape of an animal, plant or human figure of a prototile in the shape of the animal, plant or human figure, and the prototile is provided with textured patterns of the animal, the plant or the human figure corresponding to the shape of the animal, plant or human figure.

* * * * *